US007100570B2

(12) United States Patent
Miyazaki

(10) Patent No.: US 7,100,570 B2
(45) Date of Patent: Sep. 5, 2006

(54) THROTTLE CONTROL SYSTEM AND METHOD

(75) Inventor: Tsutomu Miyazaki, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/114,170

(22) Filed: Apr. 26, 2005

(65) Prior Publication Data

US 2005/0252485 A1 Nov. 17, 2005

(30) Foreign Application Priority Data

May 13, 2004 (JP) ..... 2004-143603

(51) Int. Cl.
*F02D 11/10* (2006.01)

(52) U.S. Cl. ..... 123/396; 123/399

(58) Field of Classification Search ..... 123/337, 123/361, 396, 399
See application file for complete search history.

(56) References Cited

U.S. PATENT DOCUMENTS

| | | | | |
|---|---|---|---|---|
| 4,823,749 | A * | 4/1989 | Eisenmann et al. | 123/399 |
| 5,912,538 | A * | 6/1999 | Turner | 318/280 |
| 6,029,513 | A * | 2/2000 | Kikori et al. | 123/337 |
| 6,098,594 | A * | 8/2000 | Kowatari et al. | 123/399 |
| 6,431,144 | B1 * | 8/2002 | Daly | 123/399 |

FOREIGN PATENT DOCUMENTS

| | | | |
|---|---|---|---|
| JP | A 10-176548 | | 6/1998 |
| JP | A 10-238390 | | 9/1998 |
| JP | 2002-242704 | * | 8/2002 |

* cited by examiner

*Primary Examiner*—T. M. Argenbright
(74) *Attorney, Agent, or Firm*—Oliff & Berridge, PLC

(57) ABSTRACT

The maximum driving power of a throttle motor is temporarily increased when a throttle valve is determined or expected to be in a seized-up or semi-seized-up state, which increases the possibility of the throttle valve being released from the seized-up or semi-seized-up state.

17 Claims, 7 Drawing Sheets

THROTTLE CONTROL SYSTEM AND METHOD

INCORPORATION BY REFERENCE

The disclosure of Japanese Patent Application No. 2004-143603 filed on May 13, 2004 including the specification, drawings and abstract is incorporated herein by reference in its entirety.

BACKGROUND OF THE INVENTION

1. Field of the Invention

The invention relates to throttle control system and method for an internal combustion engine.

2. Description of the Related Art

As is known in the field of the art, at extremely low temperature, so-called blow-by gas that contains much water after flowing through the passages of a PCV system (Positive Crankcase Ventilation System) causes "icing" at a throttle valve which has been cooled down by low temperature intake air. Specifically, when the blow-by gas passes through the throttle valve, the water contained therein is frozen between the throttle valve and an internal wall of a throttle bore. In view of this, Japanese Patent No. 3189717 provides a throttle control system that executes a particular procedure for determining whether a throttle motor is locked when icing occurs at the throttle valve.

More specifically, when the ambient temperature is lower than a specific temperature below which the above-mentioned throttle icing is likely to occur, this throttle control system extends an observation time that is taken before determining locking-up of the throttle motor after the locking-up has been first detected. As a result, it is possible to avoid determining locking-up of the throttle motor when the throttle motor is locked up due to icing which will typically last only for a limited time. That is, the throttle control system determines locking-up of the throttle motor only when the throttle motor is locked up due to jammed gears, or the like, which normally will not be resolved in time.

Besides, Japanese Patent No. 3458935 proposes increasing a control value when the difference between an actual throttle opening and a target throttle opening is large in order to bring the actual throttle opening to the target throttle opening quickly.

As is known, a throttle valve is exposed to water, oil, and various extraneous matters, and they may seize up the throttle valve temporarily under some conditions. In particular, at low temperature, water and oil contained in blow-by gas from a known PCV system or EGR gas from a known EGR system (Exhaust Gas Recirculation system) may form some ice and tar between the throttle valve and the inner wall of the intake passage, which seize up the throttle valve.

Also, with a conventional throttle valve made of metal such as aluminum, it is possible to prevent throttle icing by having warm water passages, for example. However, with a resin throttle valve that is now increasingly used, having such warm water passages is difficult in design. Also, the low heat capacity of such a resin valve further increases the difficulty in prevent icing at low temperature.

SUMMARY OF THE INVENTION

In view of the foregoing problems, it is an object of the invention to provide a throttle control system and a throttle control method that make it easier to release a throttle valve which has been seized up or semi-seized up due to icing, extraneous matters, and the like.

A first aspect of the invention relates to a throttle control system including a throttle valve, a throttle motor for driving the throttle valve, a motor drive portion for activating the throttle motor, a temperature sensor for detecting a temperature that is associated with a temperature of the throttle valve, and a control portion for controlling the motor drive portion. According to this throttle control system, the control portion limits a maximum driving power of the throttle motor to a limit value by the motor drive portion when the temperature detected by the temperature sensor is above a reference temperature, and the control portion increases the maximum driving power of the throttle motor above the limit value by the motor drive portion when the temperature detected by the temperature sensor is below the reference temperature.

Meanwhile, a second aspect of the invention relates to a throttle control system including a throttle valve, a throttle motor for driving the throttle valve, a motor drive portion for activating the throttle motor, and a control portion for controlling the motor drive portion. According to this throttle control system, the control portion limits a maximum driving power of the throttle motor to a limit value by the motor drive portion during a normal state, and the control portion increases the maximum driving power of the throttle motor above the limit value by the motor drive portion when the control portion determines that the throttle valve is seized up or semi-seized up.

According to the foregoing throttle control systems of the invention, when the throttle valve is determined or expected to be in a seized-up or semi-seized-up state, the maximum driving power of the throttle motor is increased and thus the possibility of the throttle valve being released from the seized-up or semi-seized-up state.

BRIEF DESCRIPTION OF THE DRAWINGS

The foregoing and/or further objects, features and advantages of the invention will become more apparent from the following description of exemplary embodiment with reference to the accompanying drawings, in which like numerals are used to represent like elements and wherein.

DETAILED DESCRIPTION OF THE EXEMPLARY EMBODIMENTS

Hereinafter, exemplary embodiments of the invention will be described with reference to the accompanying drawings.

(First Exemplary Embodiment)

Figure 1:
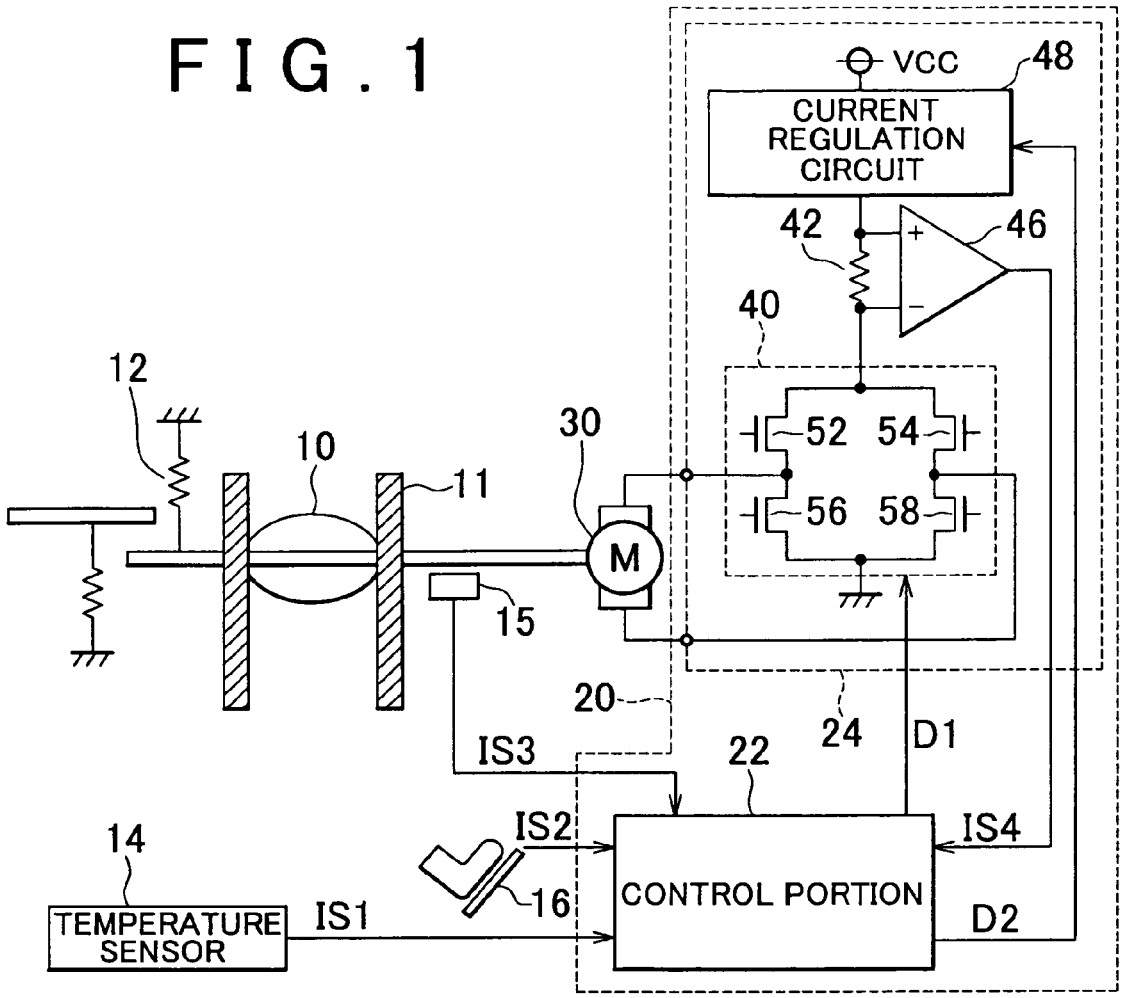
FIG. 1 is a view schematically showing the configuration of a throttle control system according to a first exemplary embodiment of the invention.

FIG. 1 schematically shows the configuration of a throttle control system according to a first exemplary embodiment of the invention. This throttle control system includes a throttle valve 10 provided in an intake passage 11, a spring 12 urging the throttle valve 10 in its closing direction, a throttle sensor 15 that detects the opening of the throttle valve 10 and produces detection signal IS3, a throttle motor 30 for driving the throttle valve 10, a temperature sensor 14 that is provided in the intake passage 11 to detect the temperature of intake air and produces detection signal IS1, an accelerator sensor 16 that detects the amount that an accelerator pedal is depressed and produces detection signal IS2, and an engine control unit 20 that controls the throttle motor 30 based on detection signals IS1 to IS3.

The engine control unit 20 includes a control portion 22 and a motor drive portion 24. The motor drive portion 24 supplies power to the throttle motor 30 under the control of the controller 22. The motor drive portion 24 includes a motor driver 40 for driving the throttle motor 30, a resistor 42 provided on a power supply line to the motor driver 40, an operational amplifier 46 that amplifies the voltage between the ends of the resistor 42, a current regulation circuit 48 that restricts the maximum current from a power supply (VCC) to the motor driver 40.

The motor driver 40 includes four switching elements (e.g., power MOSFETs) 52, 54, 56, and 58. Placing the switching elements 52, 58 in connected states and the switching elements 54, 56 in disconnected states allows current to flow through the coil of the throttle motor 30 in one direction. On the other hand, placing the switching elements 54, 56 in connected states and the switching elements 52, 58 in disconnected states allows current to flow through the coil of the throttle motor 30 in the other direction.

Thus, the control portion 22 selectively applies control voltage to control terminals of the switching elements 52, 54, 56, 58 so as to turn them on or off as needed to supply desired current to the coil of the throttle motor 30.

The operation of the throttle motor 30 is controlled through known PWM (Pulse Width Modulation) control. In a typical PWM control, the ratio of a time period during which current is applied to a motor within one cycle of each drive pulse is called a "duty ratio". The duty ratio of the throttle motor 30 is controlled by the motor driver 40 according to command signal D1 from the control portion 22. Thus, the duty ratio is one of control parameters used to control the throttle motor 30. As the duty ratio of the throttle motor 30 increases, the opening of the throttle valve 10 increases as seen in typical linear functions.

As mentioned above, the temperature sensor 14 produces detection signal IS1 indicating the intake temperature, the accelerator sensor 16 produces detection signal IS2 indicating the position of the accelerator pedal that corresponds to the amount the accelerator pedal is depressed, and the throttle sensor 15 produces detection signal IS3 indicating the opening of the throttle valve 10. Further, the operational amplifier 46 detects the current supplied from the power supply to the motor driver 40 and produces detection signal IS4 indicating the detected current.

The control portion 22 determines a target duty ratio and produces command signal D1 based on the detection signals IS1 to IS4 such that the switching elements 52 to 58 operate accordingly.

Figure 2:
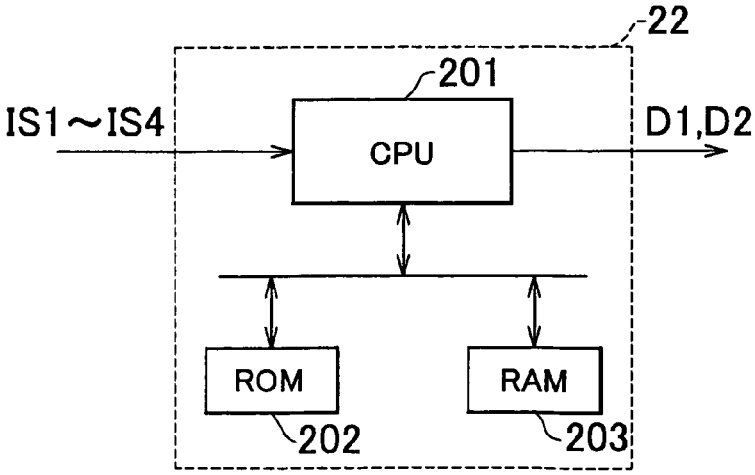
FIG. 2 is a view schematically showing the configuration of a control portion 22.

FIG. 2 shows the configuration of the control portion 22. The control portion 22 includes a CPU (Central Processing Unit) 201, a ROM (Read Only Memory) 202, and a RAM (Random Access Memory) 203, which are all connected via communication buses including a data bus and an address bus so that they exchange various data, address information, and so on. The ROM 202 stores various programs executed during the control procedures which will be described later with reference to flowcharts. The RAM 203 temporarily records various control parameters such as the values detected by the foregoing sensors.

The CPU 201 converts the detection signals IS1 to IS4 (i.e., analogue signals) produced by the respective sensors into digital signals using a known A/D converter or the like, and the CPU 201 produces, based on such digitized information, command signal D1 for controlling the switching elements 52, 54, 56, 58 of the motor driver 40 to achieve a desired duty ratio of the throttle motor 30 and command signal D2 for controlling the current regulation circuit 48 to adjust the maximum current for the motor driver 40.

Figure 3:
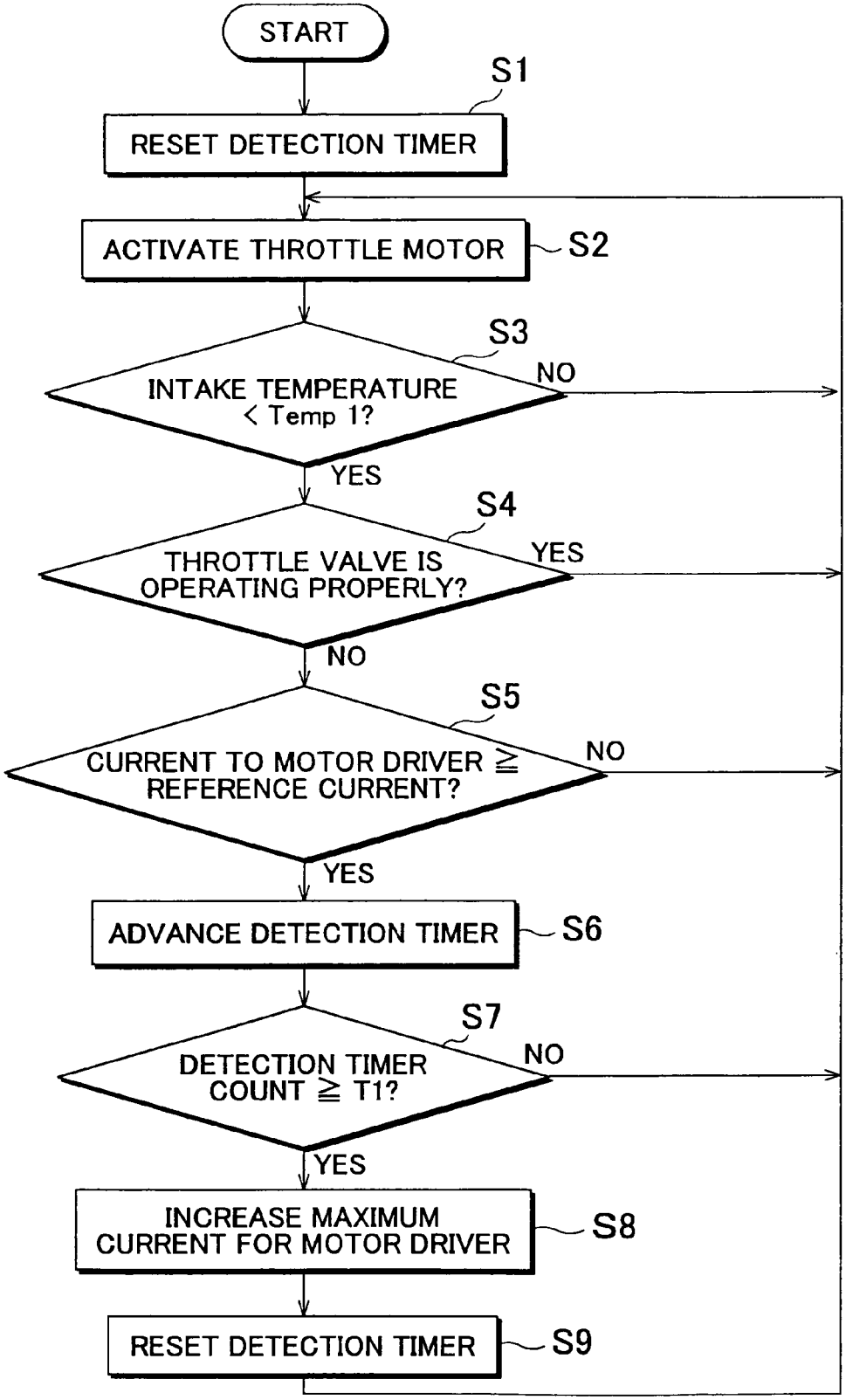
FIG. 3 is a flowchart illustrating a control routine executed by the control portion 22.

The flowchart of FIG. 3 illustrates one exemplary routine executed by the control portion 22. When the routine starts, the control portion 22 first resets a detection timer provided in the control portion 22 in step 1, after which the control portion 22 proceeds to step 2.

In step 2, the control portion 22 activates the throttle motor 30 by producing command signal D1 according to detection signal IS2 of the accelerator sensor 16 and transmitting the produced command signal D1 to the driver 40 while restricting the maximum current for the driver 40 to a specific value by command signal D2. That is, during the operation of the throttle motor 30, the current from the current regulation circuit 48 to the motor driver 40 will not exceed the maximum current unless otherwise instructed.

Next, in step 3, the control portion 22 determines whether the intake temperature detected by the temperature sensor 14 is lower than Temp 1. The lower the intake temperature, the higher the possibility of the throttle valve 10 being seized up or semi-seized up due to icing, or the like. Thus, when the intake temperature is low, it is necessary to increase the driving power of the throttle motor 30 as compared to a normal state. However, when the intake temperature is higher than a certain level, such increase in the driving power of the throttle motor 30 may result in overheat of the switching elements 52, 54, 56, 58 of the motor driver 40. Thus, the value of Temp 1 is determined in consideration of these factors.

Back to the routine, if the control portion 22 determines in step 3 that the intake temperature is equal to or higher than Temp 1, the control portion 22 then returns to step 2. If lower, conversely, the control portion 22 proceeds to step 4.

In step 4, the control portion 22 determines based on detection signal IS3 from the throttle sensor 15 whether the throttle valve 10 is properly operating. That is, when the throttle valve 10 is in a normal state without being seized up or semi-seized up due to icing or the like, the opening of the throttle valve 10 reaches a target opening within a specific period of time (e.g., 130 ms) after the control portion 22 has transmitted command signal D1 to the motor driver 40. Thus, in step 4, the control portion 22 determines if the opening of the throttle valve 10 is properly changing with respect to the target opening, as compared to such normal changes in the opening of the throttle valve 10 after transmission of command signal D1. For example, when the throttle valve 10 is seized up or semi-seized up, typically the opening of the throttle valve 10 will not change in response to command signal D1, or even if the opening changes, there will be a significant delay before or during the change of the opening.

If the control portion 22 determines in step 4 that the throttle valve 10 is operating properly (the throttle valve 10 is neither seized up nor semi-seized up), the control portion 22 returns to step 2. If not operating properly, conversely, the control portion 22 proceeds to step 5.

In step 5, the control portion 22 determines whether the current to the motor driver 40 that is indicated by detection signal IS4 of the operational amplifier 46 is greater than a reference current. In this exemplary embodiment, this reference current is set to 5A for the reason described later.

If the control portion 22 determines in step 5 that the current to the motor driver 40 is lower than 5A, the control portion 22 then returns to step 2. If equal to or greater than 5A, conversely, the control portion 22 proceeds to step 6.

In step 6, the control portion 22 advances the detection timer. In step 7, the control portion 22 determines whether the advanced timer count is equal to or greater than T1. If the timer count is less than T1, the control portion 22 returns to step 2.

With the throttle control system of this embodiment, the current to the motor driver 40 exceeds 5A for 20 ms or shorter while the throttle motor 30 is driving the throttle valve 10 in a normal state (not seized up or semi-seized up). Therefore, T1 is set to 100 ms and it is determined that the throttle valve 10 is now seized up or semi-seized up when the count of the detection timer reaches 100 ms.

Back to the routine, if the control portion 22 determines in step 7 that the timer count is equal to or greater than T1, the control portion 22 then proceeds to step 8. In step 8, the control portion 22 controls the current regulation circuit 48 via command signal D2 so as to increase the maximum current for the motor driver 40 for a limited period of time This increase in the current to the motor driver 40 will increase the driving power of the throttle motor 30 and thus the possibility of the throttle motor 30 being released from its seized-up or semi-seized-up state.

As briefly mentioned earlier, the current regulation circuit 48 restricts the current to be supplied to the switching elements 52 to 58 of the motor driver 40 to avoid their overheat, more specifically, to prevent application of large current to semiconductor elements of each switching element which may otherwise result in the temperatures of joint portions among the semiconductor elements exceeding their rated temperatures. However, when the temperature around the throttle valve 10 is very low ("YES" in step 3), the likelihood of the above joint portion temperatures exceeding their rated temperatures is extremely low. According to this exemplary embodiment, therefore, the value of Temp 1 has been predetermined in consideration of, for example, the amount of heat generated by each switching element, the amount of heat radiated therefrom, and the ambient temperature. Likewise, the foregoing time period for which the maximum supply current to the motor driver 40 is to be increased in step 8 has been predetermined based on an experimental result regarding the degree of increase in the temperature of each switching element after increasing the current to the motor driver 40 in various ways at low temperature.

Meanwhile, while the temperature sensor 14 is disposed in the intake passage 11, it may instead be disposed in, for example, the vicinity of the motor drive portion 24 for better reliability of the protection of the switching elements 52 to 58. Further, the temperature sensor 14 may be arranged to detect other temperature which correlates with the temperature of the throttle valve 10 or the temperature of the switching elements 52 to 58, such as coolant temperature, lubricant temperature. Moreover, it is possible to detect and use two or more of such temperatures in the determination as to seizing-up or semi-seizing-up of the throttle valve 10.

Back to the routine, after step 8, the control portion 22 resets the detection timer in step 9 and returns to step 2.

While in the above-described embodiment the control portion 22 temporarily increases the maximum current for the motor driver 40 when the throttle valve 10 is seized up or semi-seized up, the control portion 22 may instead remove the limit of the maximum current temporarily. As such, various other forms may be adopted to loosen the restriction of current to the motor driver 40 in response to the throttle valve 10 being seized up or semi-seized up.

Furthermore, in the above-described embodiment, the control portion 22 determines in step 5 that the throttle valve 10 is seized up or semi-seized up when the time period that the throttle valve 10 continuously fails to operate properly and the current detected by the operational amplifier 46 remains higher than the reference current (5A) exceeds T1 (100 ms). Instead, it is possible to eliminate step 4 and make step 5 a step in which the control portion 22 determines whether the current to the motor driver 40 is equal to the maximum current and determines that the throttle valve 10 is seized up or semi-seized up when the current to the motor driver 40 has been equal to the maximum current for a particular period of time. Alternatively, it is also possible to further eliminate steps 1, 6, 7, 9 that are associated with the detection timer and determine that the throttle valve 10 is seized up or semi-seized up in response to the current to the motor driver 40 reaching the maximum current.

Meanwhile, the present inventor has conducted a research to investigate the effect of the foregoing throttle control. In the research, the throttle valve 10 was seized up by producing condensed water in the EGR device and the current to the motor driver 40 was changed in various ways to ascertain whether the throttle valve 10 would be released from the seized-up state.

The research was conducted with four samples (sample number (n)=4), and the current to the motor driver 40 was changed by changing the power supply voltage (current increases as voltage increases).

In the research, 10V was first applied to the motor driver 40. The result is that any throttle valve was not released from its seized-up state (Applied voltage: 10V, Released: 0/4).

Subsequently, when the voltage was increased to 12V, one throttle valve was released (Applied voltage: 12V, Released: 1/4).

When the voltage was further increased to 14V, three throttle valves were released (Applied voltage: 14V, Released: 3/4).

Accordingly, the result of the research indicates that applying larger current or voltage to the motor driver 40 increases the possibility of the throttle valve 10 being released from its seized-up or semi-seized-up state.

According to the first exemplary embodiment, as aforementioned, the restriction of the maximum current for the driver 40 (i.e., the maximum current for the throttle motor 30) is temporarily loosened when the related temperature (e.g., intake temperature, temperature of the switching elements 52, 54, 56, 58, coolant temperature, lubricant temperature) is lower than a particular level and the throttle valve 10 is determined to be seized up or semi-seized up.

This is because, as mentioned earlier, thermal requirements to prevent overheat of the switching elements 52 to 58 become less strict at low temperature than at high temperature. Furthermore, the restriction of the maximum current for the motor driver 40 is loosened only for a limited period of time, which is also for preventing overheat of the switching elements 52, 54, 56, 58. However, even such temporal increase in the current to the motor driver 40 will sufficiently increase the possibility of the throttle valve 10 being released from its seized-up state or semi-seized-up state.

(Second Exemplary Embodiment)

Figure 4:
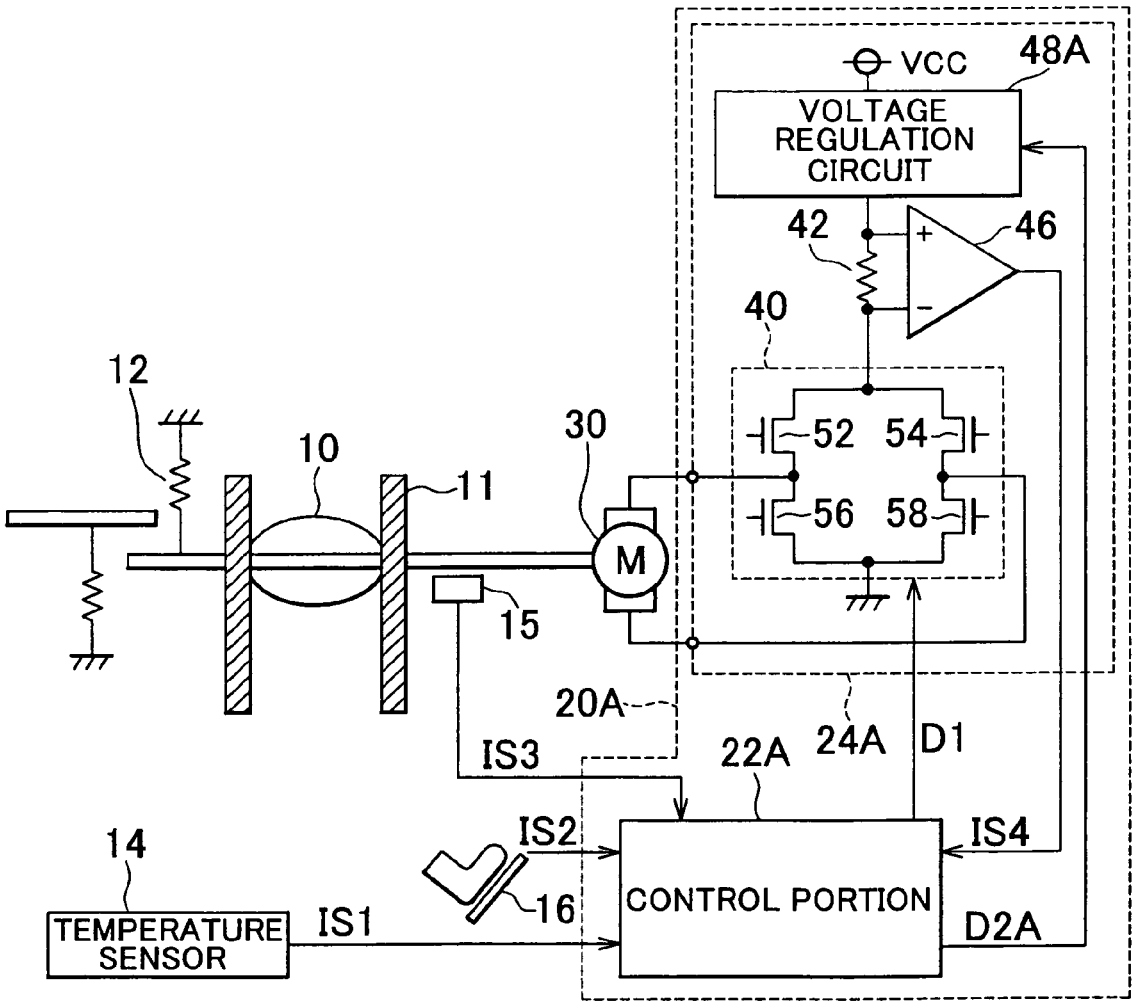
FIG. 4 is a view schematically showing the configuration of a throttle control system according to a second exemplary embodiment of the invention.

FIG. 4 schematically shows the configuration of a throttle control system according to a second exemplary embodiment of the invention. This system includes an engine control unit 20A in place of the engine control unit 20 of the first exemplary embodiment.

The engine control unit 20A includes a control portion 22A and a motor drive portion 24A. The control portion 22A has the same structure as the control portion 22 shown in FIG. 2, and therefore the explanation regarding its structure will be omitted. Likewise, the motor drive portion 24A has substantially the same structure as the motor drive portion 24 shown in FIG. 2, but it includes a voltage regulation circuit 48A in place of the current regulation circuit 48. The control portion 22A controls the voltage regulation circuit 48A by command signal D2A and increases power supply voltage VCC (i.e., voltage supplied from a battery, not shown) under given conditions.

Figure 5:
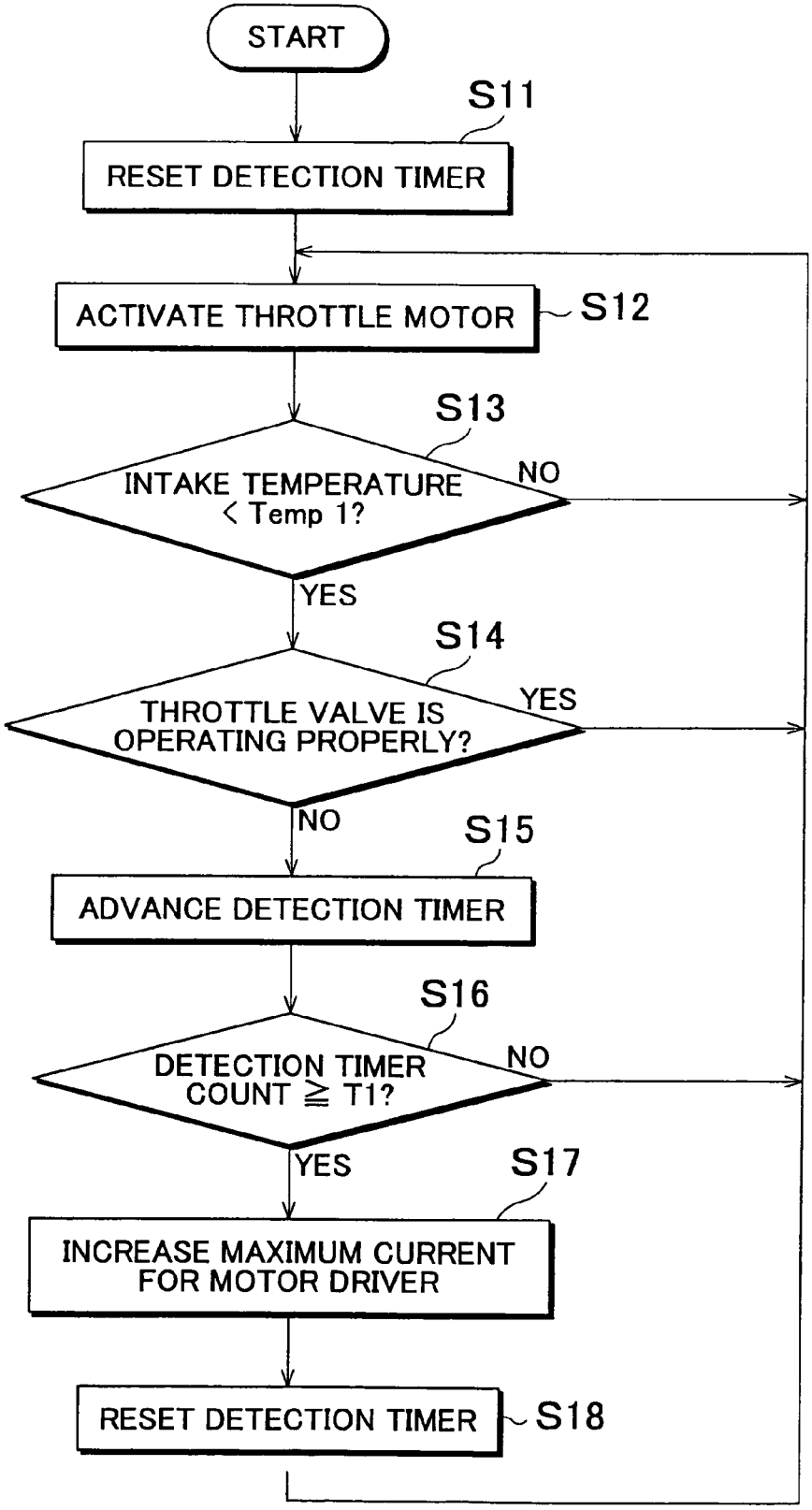
FIG. 5 is a flowchart illustrating a control routine executed by a control portion 22A.

The flowchart of FIG. 5 illustrates one exemplary routine executed by the control portion 22A. When the routine starts, the control portion 22A first resets a detection timer provided therein in step 11.

Next, in step 12, the control portion 22A activates the throttle motor 30 by command signal D1 which has been produced based on detection signal IS2 from the accelerator sensor 16, so as to bring the opening of the throttle valve 10 to a target value while controlling the voltage regulation circuit 48A by command signal D2A to produce particular voltage. After step 12, the control portion 22A proceeds to step 13.

In step 13, the control portion 22A determines whether the intake temperature detected by the temperature sensor 14 is lower than Temp 1.

If the control portion 22A determines in step 13 that the intake temperature is equal to or higher than Temp 1, the control portion 22A then returns to step 12. If lower, conversely, the control portion 22A proceeds to step 14.

In step 14, the control portion 22A determines based on detection signal IS3 from the throttle sensor 15 whether the throttle valve 10 is operating properly. Note that it is also possible to make step 14 a step in which the control portion 22A makes said determination based on whether the current detected by the operational amplifier 46 (i.e., current supplied to the motor driver 40) is larger than a particular level, as in step 5 of the first exemplary embodiment.

Back to the routine, if the control portion 22A determines in step 14 that the throttle valve 10 is operating properly (the throttle valve 10 is neither seized up nor semi-seized up), the control portion 22A returns to step 12. If not operating properly, conversely, the control portion 22A proceeds to step 15.

In step 15, the control portion 22A advances the detection timer. In step 16, the control portion 22A determines whether the advanced timer count is greater than T1. If the timer count is less than T1, the control portion 22A returns to step 12.

If the timer count is greater than T1, the control portion 22A then proceeds to step 17. In step 17, the control portion 22A controls the voltage regulation circuit 48A by command signal D2A so as to increase the power supply voltage for a limited period of time. This increase in the power supply voltage will increase the driving power of the throttle motor 30 accordingly and thus the possibility of the throttle motor 30 being released from its seized-up or semi-seized-up state.

After step 17, the control portion 22 resets the detection timer in step 18 and returns to step 12.

While in the second exemplary embodiment the control portion 22A temporarily increases the power supply voltage at low temperature, the control portion 22A may instead switch the power supply voltage from a first voltage to a second voltage that is higher than the first voltage at low temperature, or the control portion 22A may control the voltage regulation circuit 48A so as to reduce the power supply voltage at normal temperature and cancel that voltage reduction at low temperature.

Thus, according to the second exemplary embodiment, when the throttle valve 10 is seized up or semi-seized up, the engine control unit 20A temporarily increases the voltage to the motor driver 40 by the voltage regulation circuit 48A (e.g., 12V to 24V) so as to increase the maximum driving power of the throttle motor 30 and thus the possibility of the throttle valve 10 being released from its seized-up or semi-seized-up state.

(Third Exemplary Embodiment)

Figure 6:
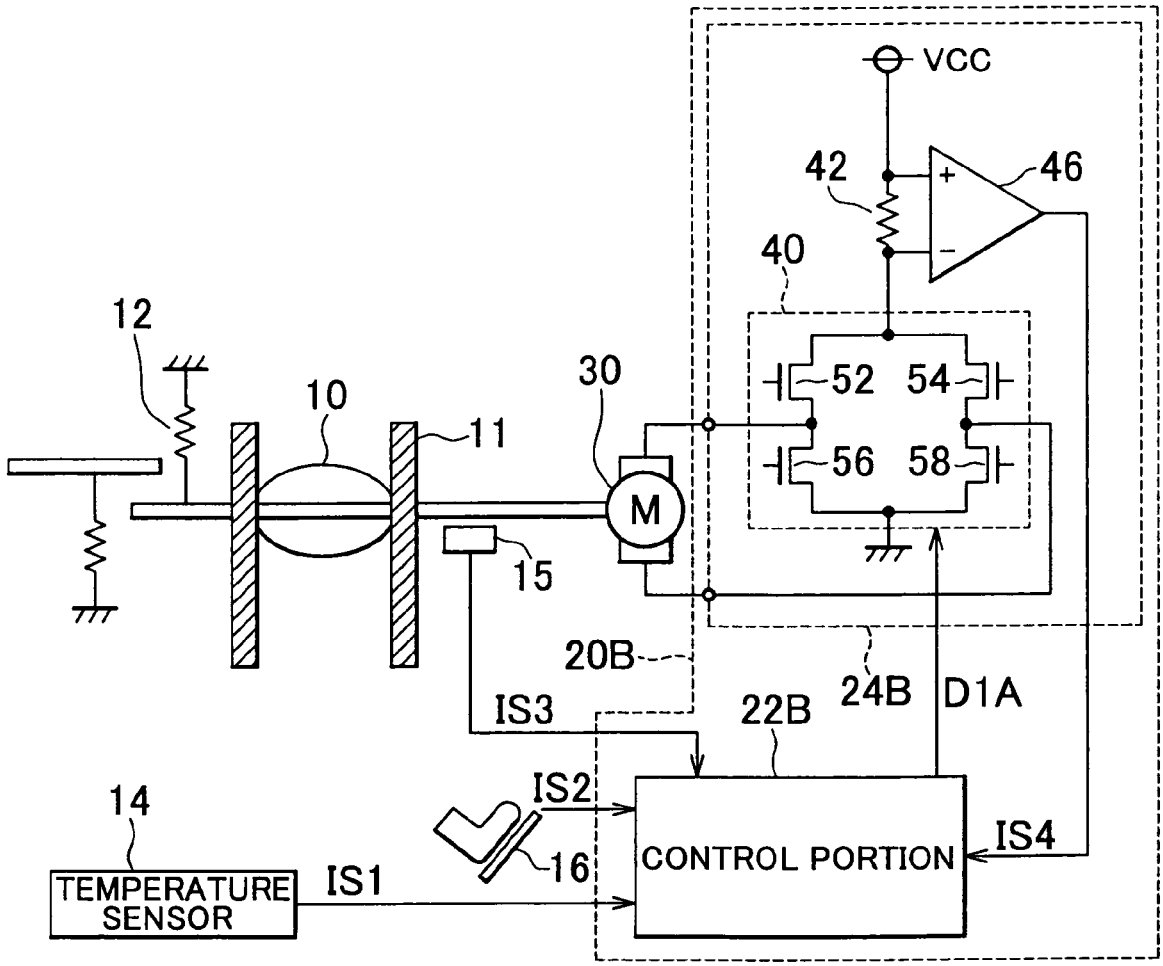
FIG. 6 is a view schematically showing the configuration of a throttle control system according to a third exemplary embodiment of the invention.

FIG. 6 shows the configuration of a throttle control system according to a third exemplary embodiment of the invention. Referring to FIG. 6, this throttle control system has substantially the same structure as that of the first exemplary embodiment but it includes an engine control unit 20B in place of the engine control unit 20.

The engine control unit 20B includes a control portion 22B and a motor drive portion 24B. The control portion 22B has the same structure as the control portion 22A of the first embodiment, and therefore the explanation on its structure will be omitted. Likewise, the motor drive portion 24B has substantially the same structure as the motor drive portion 24 shown in FIG. 2, but it does not include the current regulation circuit 48 and so the power supply voltage (VCC) is directly applied to the motor driver 40 via the resistor 42.

As mentioned earlier, the operation of the throttle motor 30 is controlled through a known PWM control, and the control portion 22B controls the duty ratio of the throttle motor 30 by command signal D1A. Thus, the duty ratio is one of control parameters used to control the throttle motor 30. As the duty ratio increases, the opening of the throttle valve 10 increases as seen in typical linear functions. During a normal state, the duty ratio of the throttle motor 30 is limited below a limit duty ratio which is set to 70% in this exemplary embodiment.

Figure 7:
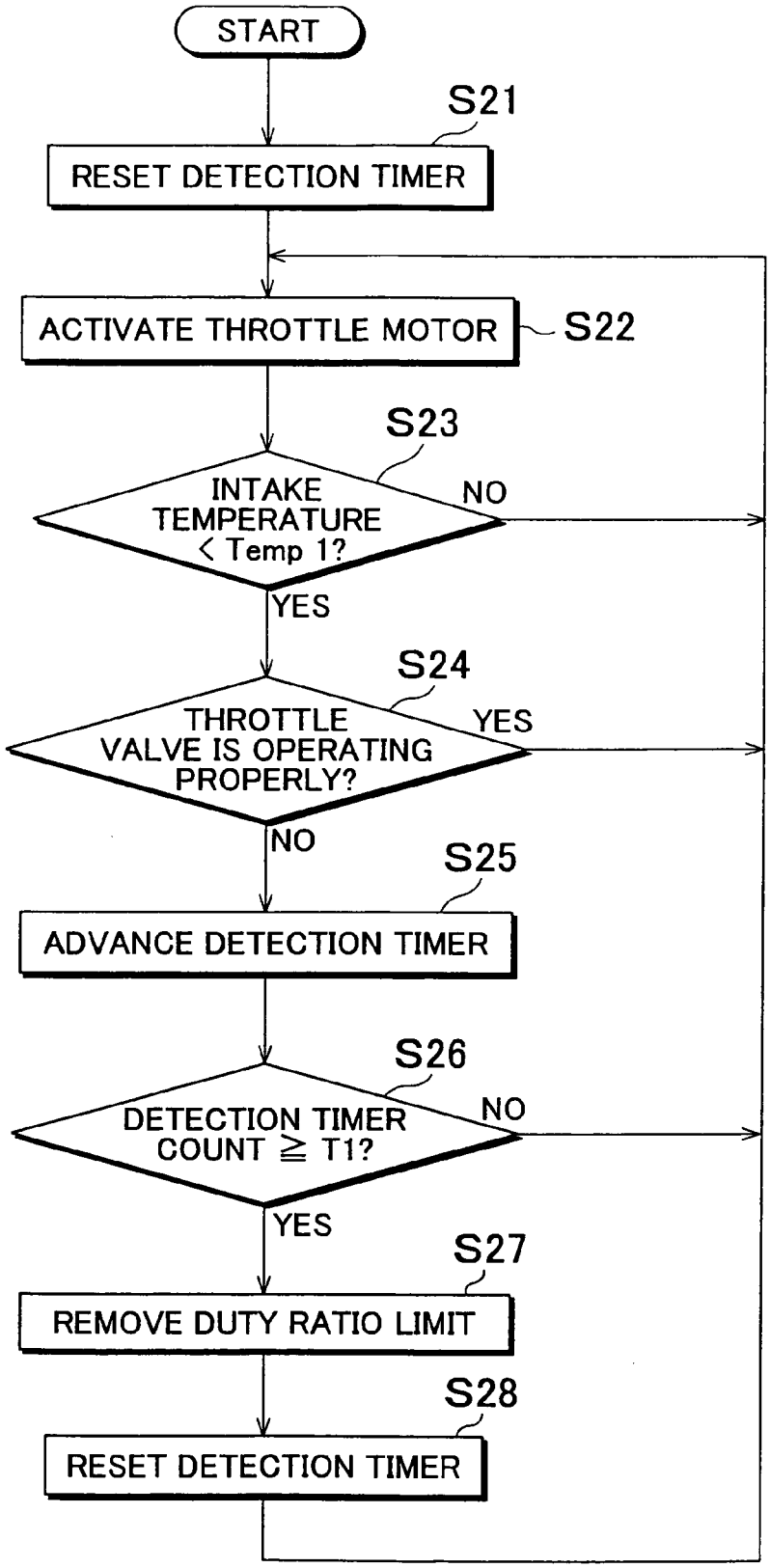
FIG. 7 is a flowchart illustrating a control routine executed by a control portion 22B.

The flowchart of FIG. 7 illustrates one exemplary routine executed by the control portion 22B. When the routine starts, the control portion 22B first resets a detection timer provided therein in step 21.

Next, in step 22, the control portion 22B activates the throttle motor 30 by command signal D1A which has been produced based on detection signal IS2 from the accelerator sensor 16, so as to bring the opening of the throttle valve 10 to a target value. Here, the motor driver 40 operates the throttle motor 30 at a particular duty ratio below the limit duty ratio of 70%.

Next, in step 23, the control portion 22B determines whether the intake temperature detected by the temperature sensor 14 is lower than Temp 1.

If the control portion 22B determines in step 23 that the intake temperature is equal to or higher than Temp 1, the control portion 22B then returns to step 22. If lower, conversely, the control portion 22B proceeds to step 24.

In step 24, the control portion 22B determines based on detection signal IS3 from the throttle sensor 15 whether the throttle valve 10 is operating properly. Note that it is also possible to make step 24 a step in which the control portion 22B makes said determination based on whether the current detected by the operational amplifier 46 (i.e., current to the motor driver 40) is larger than a particular level, as in step 5 of the first exemplary embodiment described above.

If the control portion 22B determines in step 24 that the throttle valve 10 is operating properly (the throttle valve 10 is neither seized up nor semi-seized up), the control portion 22B returns to step 22. If not operating properly, conversely, the control portion 22B proceeds to step 25.

In step 25, the control portion 22B advances the detection timer. In step 26, the control portion 22B determines whether the advanced timer count is equal to or greater than T1. If the timer count is less than T1, the control portion 22B returns to step 22.

If the control portion 22B determines in step 26 that the timer count is equal to or greater than T1, it then proceeds to step 27. In step 27, the control portion 22B controls the motor driver 40 via command signal D1A so as to remove the limit of the duty ratio of the throttle motor 30 so that the duty ratio of the throttle motor 30 can increase above 70%. This increase in the duty ratio of the throttle motor 30 will increase the maximum driving power of the throttle motor 30 and thus the possibility of the throttle motor 30 being released from its seized-up or semi-seized-up state.

After step 27, the control portion 22B resets the detection timer in step 28 and returns to step 22.

While in the third exemplary embodiment the control portion 22B temporarily removes the limit of the duty ratio of the throttle motor 30 at low temperature, it may instead switch the limit duty ratio from a first value to a second value that is larger than the first value at low temperature. As such, various other forms may be adopted to loosen the restriction of the duty ratio of the throttle motor 30.

Thus, according to the third exemplary embodiment, when the throttle valve 10 is seized up or semi-seized up, the control portion 22B temporarily loosens the restriction of the duty ratio of the throttle motor 30, more specifically it temporarily removes the limit of the same ratio (70% to 100%), which will increase the maximum driving power of the throttle motor 30 and thus the possibility of the throttle valve 10 being released from its seized-up or semi-seized-up state.

MODIFICATION EXAMPLES

In the above-described embodiments, whether the throttle valve 10 is seized-up or semi-seized-up is determined when the temperature detected by the temperature sensor 14 is low, and the maximum driving power of the throttle motor 30 is increased if the throttle valve 10 is determined to be seized-up or semi-seized up. In another embodiment, the maximum driving power of the throttle motor 30 may just be increased at low temperature regardless of the state of the throttle valve 10 as illustrated in FIG. 8.

Figure 8:
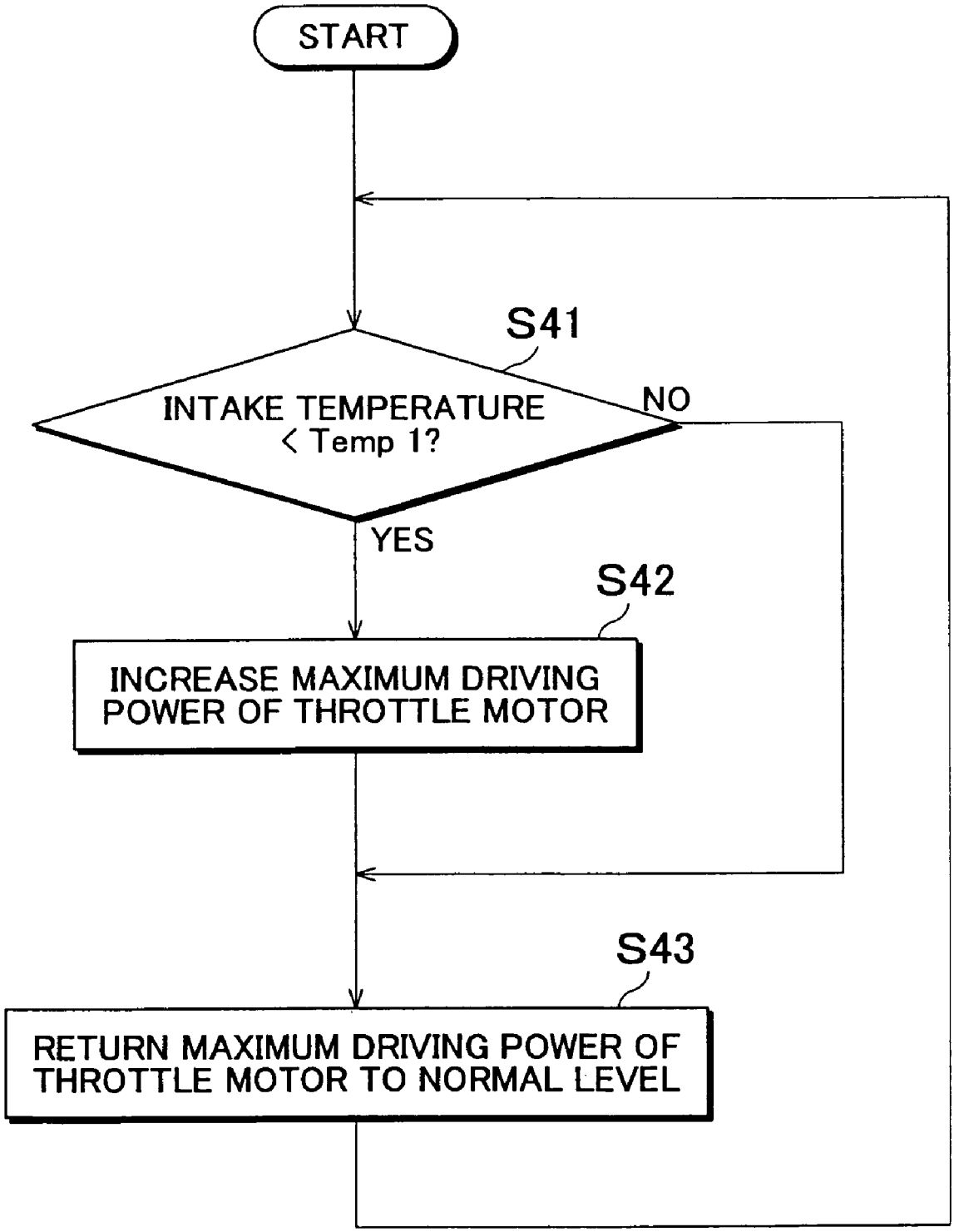
FIG. 8 is a flowchart illustrating a control routine as a modification example of the first to third exemplary embodiments.

When the routine of FIG. 8 starts, it is determined in step 41 whether the temperature detected by the temperature sensor 14 is lower than Temp 1. If lower than Temp 1, the maximum driving power of the throttle motor 30 is increased from its normal value and the throttle motor 30 is then operated for a limited period of time (e.g., 5 minutes after engine start) under this condition. This increased maximum driving power of the throttle motor 30 increases the possibility that the throttle valve 10 which has been seized up or semi-seized up due to icing or the like would be released.

Note that the increase of the maximum driving power of the throttle motor 30 in step 42 may be accomplished by, for example, increasing the maximum power supply current, the maximum power supply voltage, or the duty ratio of the throttle motor 30 as in the foregoing exemplary embodiments.

Meanwhile, if it has been determined in step 41 that the temperature detected by the temperature sensor 14 is equal to or higher than Temp 1, step 42 is skipped. In step 43, the maximum driving power of the throttle motor 30 is set to the normal value and the motor is operated accordingly.

After step 43, the routine restarts from step 41 in which the temperature detected by the temperature sensor 14 is again compared with Temp 1. That is, in the case where this throttle control routine is performed at engine start, the temperature around the throttle valve 10 may be affected by the operating state of the engine after started. For example, when the engine keeps idling for a while after started or the engine is stopped immediately after started, the temperature around the throttle valve 10 does not increase significantly. Conversely, when the engine runs at high speed (e.g., highway driving) immediately after started, the temperature around the throttle valve 10 increases significantly. To cope with such various engine operation conditions after engine start, it is necessary to repeat the determination as to the temperature detected by 14 at specific time intervals.

Thus, the modification example shown in FIG. 8 provides a simpler control procedure for a throttle control system which increases the possibility of the throttle valve 10 being released from its seized-up or semi-seized-up state.

While the invention has been described with reference to exemplary embodiments thereof, it is to be understood that the invention is not limited to the exemplary embodiments or constructions. To the contrary, the invention is intended to cover various modifications and equivalent arrangements other than described above. In addition, while the various elements of the exemplary embodiments are shown in various combinations and configurations, which are exemplary, other combinations and configurations, including more, less or only a single element, are also within the spirit and scope of the invention.

What is claimed is:

1. A throttle control system, comprising:

a throttle valve;

a throttle motor for driving the throttle valve;

a motor drive portion for activating the throttle motor;

a temperature sensor for detecting a temperature that is associated with a temperature of the throttle valve; and a control portion for controlling the motor drive portion, wherein the control portion limits a maximum driving power of the throttle motor to a limit value by the motor drive portion when the temperature detected by the temperature sensor is above a reference temperature; and the control portion increases the maximum driving power of the throttle motor above the limit value by the motor drive portion when the temperature detected by the temperature sensor is below the reference temperature.

2. A throttle control system according to claim 1, wherein the motor drive portion includes a current restricting circuit that restricts a maximum value of a power supply current under the control of the control portion, and a motor activating circuit that activates the throttle motor with the power supply current restricted by the current restricting circuit; and the control portion accomplishes the increase of the maximum driving power of the throttle motor by loosening the restriction of the power supply current by the current restricting circuit.

3. A throttle control system according to claim 1, wherein the motor drive portion includes a power supply circuit that produces a power supply voltage under the control of the control portion, the power supply voltage being set to a first level during a normal state, and a motor activating circuit that activates the throttle motor with the power supply voltage produced by the power supply circuit; and the control portion accomplishes the increase of the maximum driving power of the throttle motor by increasing the power supply voltage from the first level to a second level that is higher than the first level.

4. A throttle control system according to claim 1, wherein the motor drive portion includes a motor activating circuit that activates the throttle motor while controlling a duty ratio of the throttle motor through pulse width modulation under the control of the control portion, the duty ratio being restricted below a maximum duty ratio during a normal state; and the control portion accomplishes the increase of the maximum driving power of the throttle motor by loosening the restriction of the duty ratio of the throttle motor.

5. A throttle control system according to claim 1, wherein the temperature detected by the temperature sensor includes a temperature of an intake air.

6. A throttle control system according to claim 1, wherein the temperature detected by the temperature sensor includes a temperature of the motor drive portion.

7. A throttle control system according to claim 1, wherein the temperature detected by the temperature sensor includes a temperature of a coolant.

8. A throttle control system according to claim 1, wherein the temperature detected by the temperature sensor includes a temperature of a lubricant.

9. A throttle control system comprising:

a throttle valve;

a throttle motor for driving the throttle valve;

a motor drive portion for activating the throttle motor; and a control portion for controlling the motor drive portion, wherein the control portion limits a maximum driving power of the throttle motor to a limit value by the motor drive portion during a normal state;

the control portion increases the maximum driving power of the throttle motor above the limit value by the motor drive portion when the control portion determines that the throttle valve is seized up or semi-seized up;

the motor drive portion includes a current restricting circuit that restricts a maximum value of a power supply current under the control of the control portion, and a motor activating circuit that activates the throttle motor with the power supply current restricted by the current restricting circuit; and the control portion accomplishes the increase of the maximum driving power of the throttle motor by loosening the restriction of the power supply current by the current restricting circuit.

10. A throttle control system comprising:

a throttle valve;

a throttle motor for driving the throttle valve;

a motor drive portion for activating the throttle motor; and a control portion for controlling the motor drive portion, wherein the control portion limits a maximum driving power of the throttle motor to a limit value by the motor drive portion during a normal state;

the control portion increases the maximum driving power of the throttle motor above the limit value by the motor drive portion when the control portion determines that the throttle valve is seized up or semi-seized up;

the motor drive portion includes a motor activating circuit that activates the throttle motor while controlling a duty ratio of the throttle motor through pulse width modulation under the control of the control portion, the duty ratio being restricted below a maximum duty ratio during the normal state; and the control portion accomplishes the increase of the maximum driving power of the throttle motor by loosening the restriction of the duty ratio of the throttle motor.

11. A throttle control system comprising:

a throttle valve;

a throttle motor for driving the throttle valve;

a motor drive portion for activating the throttle motor;

a temperature sensor for detecting a temperature that is associated with a temperature of the throttle valve; and a control portion for controlling the motor drive portion, wherein the control portion limits a maximum driving power of the throttle motor to a limit value by the motor drive portion during a normal state;

the control portion increases the maximum driving power of the throttle motor above the limit value by the motor drive portion when the control portion determines that the throttle valve is seized up or semi-seized up: and the control portion uses the output of the temperature sensor in the determination as to whether the throttle valve is seized up or semi-seized up.

12. A throttle control system according to claim 11, wherein the temperature detected by the temperature sensor includes a temperature of an intake air.

13. A throttle control system according to claim 11, wherein the temperature detected by the temperature sensor includes a temperature of the motor drive portion.

14. A throttle control system according to claim 11, wherein the temperature detected by the temperature sensor includes a temperature of a coolant.

15. A throttle control system according to claim 11, wherein the temperature detected by the temperature sensor includes a temperature of a lubricant.

16. A throttle control system comprising:

a throttle valve;

a throttle motor for driving the throttle valve;

a motor drive portion for activating the throttle motor;

a current detector for detecting a current applied to the throttle motor; and a control portion for controlling the motor drive portion, wherein the control portion limits a maximum driving power of the throttle motor to a limit value by the motor drive portion during a normal state;

the control portion increases the maximum driving power of the throttle motor above the limit value by the motor drive portion when the control portion determines that the throttle valve is seized up or semi-seized up; and the control portion uses the output of the current detector in the determination as to whether the throttle valve is seized up or semi-seized up.

17. A method for controlling a throttle motor for driving a throttle valve, comprising:

obtaining a temperature that is associated with a temperature of the throttle valve; and increasing a maximum driving power of the throttle motor if the temperature is below a reference temperature, otherwise limiting the maximum driving power of the throttle motor to a limit value if the temperature is not below the reference temperature.

* * * * *